US009658016B2

(12) United States Patent
Rye

(10) Patent No.: US 9,658,016 B2
(45) Date of Patent: May 23, 2017

(54) FIREARM HAMMER SPRING REMOVAL AND INSTALLATION KIT

(71) Applicant: Charles F Rye, Bartlett, TN (US)

(72) Inventor: Charles F Rye, Bartlett, TN (US)

( * ) Notice: Subject to any disclaimer, the term of this patent is extended or adjusted under 35 U.S.C. 154(b) by 53 days.

(21) Appl. No.: 14/620,076

(22) Filed: Feb. 11, 2015

(65) Prior Publication Data

US 2016/0245606 A1 Aug. 25, 2016

Related U.S. Application Data

(60) Provisional application No. 61/965,958, filed on Feb. 11, 2014.

(51) Int. Cl.
*F41A 15/00* (2006.01)
*F41A 19/14* (2006.01)

(52) U.S. Cl.
CPC ..... *F41A 19/14* (2013.01)

(58) Field of Classification Search
USPC ..... 42/90, 108, 106
See application file for complete search history.

(56) References Cited

U.S. PATENT DOCUMENTS 5,417,003 A * 5/1995 Claveau ..... F41A 9/83 42/87
8,607,493 B2 * 12/2013 Wray ..... F41A 11/00 42/108
8,640,375 B2 * 2/2014 Ketchum ..... F41A 11/00 42/108
8,726,561 B1 * 5/2014 Hampton ..... F41A 9/65 42/106
8,756,851 B2 * 6/2014 Horne ..... F41C 27/00 42/90
8,776,426 B1 * 7/2014 Symonds ..... F41A 17/38 42/49.02

* cited by examiner

*Primary Examiner* — J. Woodrow Eldred
(74) *Attorney, Agent, or Firm* — Charles F. Rye

(57) ABSTRACT

The present invention is related to hammer and hammer spring assembly from firearms especially but, not limited to, Stoner Automatic Rifle (SAR) variants, other firearms and other non-firearm mechanisms. The system and method is intended to relieve the hammer spring pressure during removal and installation the hammer. This is accomplished by capturing the hammer and spring legs onto a retainer which holds the spring legs in a position that does not engage any of the nearby features and allows the hammer, spring and retainer to float freely as one assembly on the hammer rotating pin. The system may utilize different shape retainers for other spring shapes and the spring spoon may have other cavity shapes to facilitate manipulating spring legs that are formed to engage on or over pins or other features for use in other firearms or non-firearm assemblies.

2 Claims, 2 Drawing Sheets

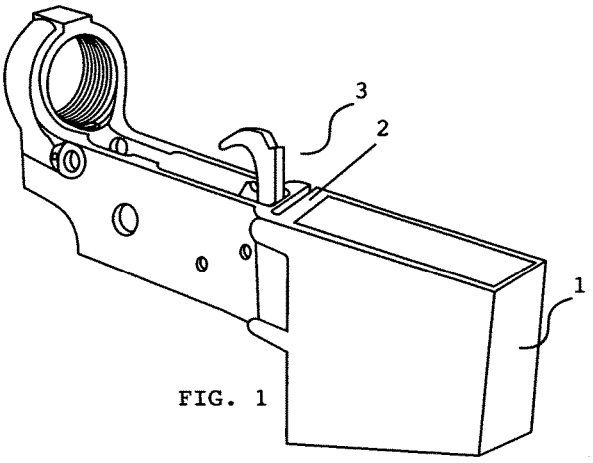
FIG. 1
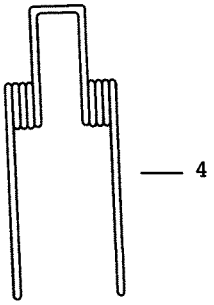
FIG. 3
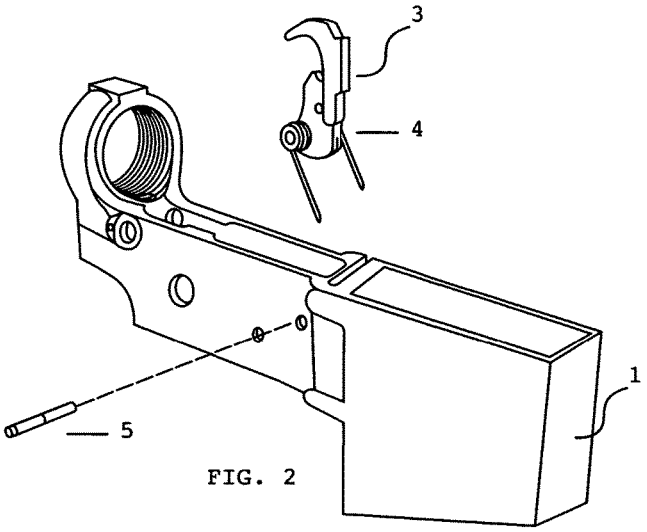
FIG. 2
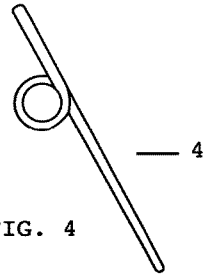
FIG. 4
FIG. 5
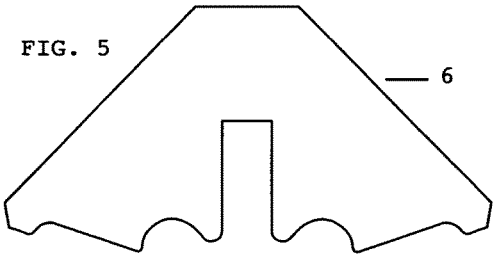
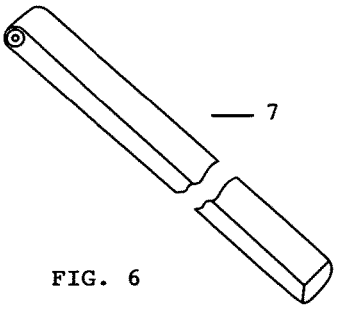
FIG. 6

FIREARM HAMMER SPRING REMOVAL AND INSTALLATION KIT

BACKGROUND OF THE INVENTION

Eugene Stoner received a patent for a gas operated self-loading rifle which revolutionized firearm design and gave him a place in history next to the likes of Browning and Garand. The M16 variant is still a mainstay in many military arsenals. The AR15 as owned by many civilians is normally semi-auto only. The receiver is divided into the upper and lower groups. The trigger, hammer and associated mechanisms are located in the lower receiver. The hammer is powered by a double torsion spring with the hammer located between and supporting the coils with the spring's loop between the coils wrapped around the back of the hammer and with the spring legs normally acting against the trigger mechanism. The AR15 has a very simple layout for lower production cost, cleaning and maintenance. However, removing and especially installing the hammer pivot pin is hampered by the preload tension of the hammer spring. While attempting to install a hammer and spring assembly the spring legs are acting on the trigger section and urging the assembly both upward and rearward against the pressure being applied in an attempt to align the hammer pivot bore with a bore on each side of the lower receiver as the hammer pivot pin is passed through all three and its leading edge must overcome the retaining detent spring in the hammer itself. Even though in disassembly the pivot pin is normally displaced with a slightly smaller diameter pin tool when the pin tool is retracted the hammer and spring assembly can flex sideways upon retracting the pin tool from one side of the receiver and upon complete removal the pin tool the hammer and spring assembly can be propelled some distance by the preload spring force.

SUMMARY OF THE INVENTION

The current invention provides a spring retainer and a hammer spring control/placement means, hamAR cage, which mounts on the hammer/hammer spring assembly by its backbone contacting the hammer face and legs which extend into the trigger housing well. It also provides hooks to hold the spring legs retracted toward the hammer face in order to eliminate preload tension and provide some degrees of free rotation having removed all hammer spring preload tension on the hammer pivot pin. The pivot pin normally includes a groove in its midsection which is acted on by a retaining spring in the hammer to secure the pin. The hammer pin can normally be dislodged from the retainer by hand force applied to a punch pin or may require a slight tap on the pin tool. Moving the hammer spring legs from their normal position is problematic as the trigger assembly urges the spring legs against the wall of the receiver. A curved or angled pick may be used to attempt to pick the spring legs from the receiver wall and lift them into the spring hooks of the hamAR cage. However as the spring is lifted it tends to increase curvature in its length increasing the difficulty to control the spring leg position. The pick itself may interfere with seating the spring leg into the spring hook. An early attempt to create a convenient spring leg control tool consisting of a round shank with a downward angle spring slot cut into a side of its distal end proved problematic as it would often cam off the spring leg and the original capture of the spring leg often took several attempts. The present invention includes a spring spoon. The spoon is a shank with a flat face and at one end defining a cavity of a cone shape with a smaller diameter, at least slightly larger than the diameter of the spring leg, closed end apex cylinder located at the apex of the cone. The cone cavity is nominally the shape of a common center drill as known in the metal machining industry. The end of the spring spoon proximal to the cavity is radius-ed to match the radius of the cavity entry forming a keen edge. The keen edge is useful to urge the hammer spring from the receiver wall and as the user applies force parallel with the spring leg and toward the coils the cone cavity guides the spring end into the apex cylinder. The apex cylinder transits the spring tension parallel to the length of the spoon and eliminates off angle force vectors that would be created by the spring end leg acting on the conical portion of the cavity. So long as the user applies pressure on the spring spoon parallel to the leg and toward the coil the leg is captured in the apex cylinder. The spring leg may now be manipulated in two axis of motion to move to a desired position. The spring spoon is intentionally slim to accommodate the limited working room in the receiver. The hammer spring legs may now be seated into the hooks of the hamAR cage. The hamAR cage is designed with open tolerance between its legs relative to the hammer thickness so that it may be moved, twisted, from side to side in the trigger housing cavity so the user can move one of its hooks closer to the hammer spring leg to accommodate capture or further away to create working room for the spring spoon.

The preferred embodiment may be dimensionally modified or number and position of spring hooks or addition of spring retaining protrusions to provide spring load relief in other applications and even built to retain single torsion springs. It may also be constructed of 2 or more pieces and providing a more three dimensional spring saddle shaped to control the spring coil during off side loading of the spring legs at each end of the coil normally controlled by being mounted on a shaft. The spring spoon cavity may include an adjacent valley shape joined to the cone shape and provide a keen edge extending on the spoon shank. The cavity may describe shapes other than a cone with or without a keen edge which would still guide a spring leg end into an apex cylinder. The spring control cavity may be other than 90 degrees to the length of the spoon and the shank of the length may be formed in order to reach around obstacles. The cavity may also define slots in its side in order to accommodate being placed over a shaft and accommodate spring ends having the shape of a loop to fit on a shaft or other non-straight leg design. These would necessitate a cavity and apex cylinder of a more rectilinear shape. The preferred embodiment is not intended as a limitation as those skilled in the art may envision alternate uses and embodiments of the novelty presented.

BRIEF DESCRIPTION OF THE DRAWINGS

FIG. 1. Shows an oblique view of the right hand side of an AR15 lower receiver with the hammer protruding above the lower reciever.

FIG. 2. Shows an oblique view of the right hand side of an AR15 lower receiver with the hammer and hammer spring assembly removed and above the lower reciever.

FIG. 3. Shows a front view of a hammer spring.

FIG. 4. Shows a side view of a hammer spring.

FIG. 5. Shows a flat pattern view of the hamAR cage spring retainer sheet metal blank.

FIG. 6. Shows the spring spoon.

DETAIL DESCRIPTION OF THE DRAWINGS

Figure 7:
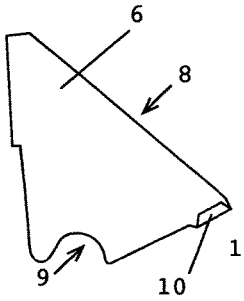
FIG. 7. Shows a side view of a formed hamAR cage.

FIG. 1. Shows an oblique view of the right hand side of an AR15 lower receiver 1 and the forward web 2 of the trigger housing with the hammer 3 protruding above the lower receiver.

FIG. 2. Shows an oblique view of the right hand side of an AR15 lower receiver 1 with the hammer and hammer spring assembly 3, 4 removed and above the lower receiver.

FIG. 3. Shows a front view of a hammer spring 4.

FIG. 4. Shows a side view of a hammer spring 4.

FIG. 5. Shows a flat pattern view of the hamAR cage 6 spring retainer sheet metal blank.

FIG. 6. Shows the spring spoon 7.

FIG. 7. Shows a side view of a formed hamAR cage 6, leg 8, spring saddle 9, hook 10 and back bone 14.

Figure 8:
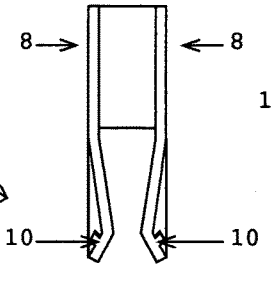
FIG. 8. Shows a front view of a formed hamAR cage.

FIG. 8. Shows a front view of a formed hamAR cage 6 leg 8, hook 10 and back bone 14.

Figure 9:
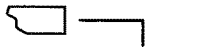
FIG. 9. Shows a front view of the spring spoon including the spring control cavity.

FIG. 9. Shows a front view of the spring spoon 7, spring control cavity 11, keen edge 12 and cylinder apex 13.

Figure 10:
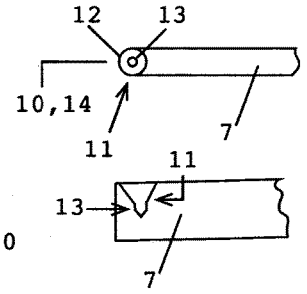
FIG. 10. Shows a cutaway view of the conical spring control cavity.

FIG. 10. Shows a cutaway view of spring spoon 7, spring control cavity 11, keen edge 12 and cylinder apex 13.

Figure 11:
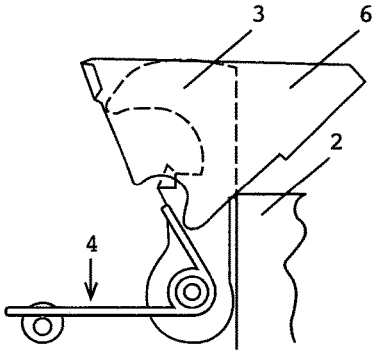
FIG. 11. Shows the hamAR cage being positioned around an installed hammer.

FIG. 11. Shows the hamAR cage 6 being positioned around an installed hammer/hammer spring assembly 3, 4 with a leg 8 on each side of the hammer 3 as back bone 14 is moved toward the face of hammer 3 as the hammer is still urged against forward web 2 of the trigger housing.

Figure 12:
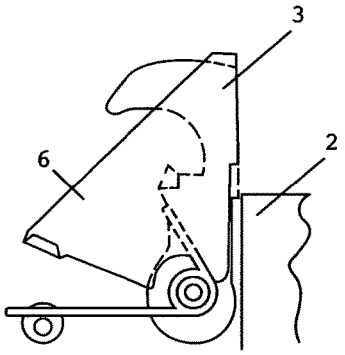
FIG. 12. Shows the hamAR cage positioned on the hammer/hammer spring assembly with the spring saddle engaged on the spring coils.

FIG. 12. Shows the hamAR cage 6 positioned on the hammer/hammer spring assembly 3, 4 with back bone 14 engaged on the face of hammer 3 and the spring saddles 9 engaged on the spring coils.

Figure 13:
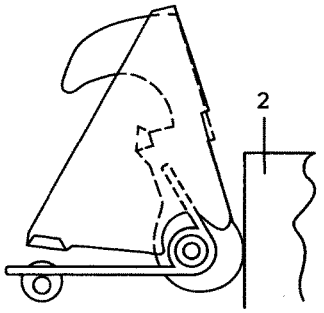
FIG. 13. Shows the hamAR cage positioned on the hammer/hammer spring assembly as the group has been rotated on the hammer pin toward the back of the trigger housing.

FIG. 13. Shows the hamAR cage 6 positioned on the hammer/hammer spring assembly 3,4 as the group has been rotated on the hammer pin 5 toward the back of the trigger housing.

Figure 14:
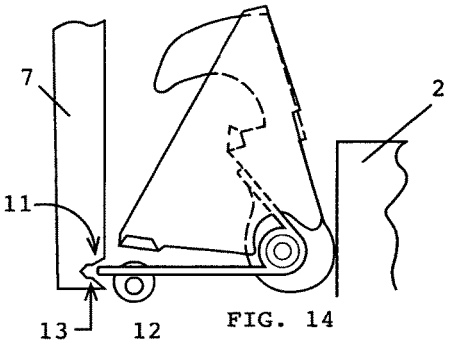
FIG. 14. Shows a cutaway of the spring spoon spring control cavity with the apex cylinder engaged on the spring leg.

FIG. 14. Shows a cutaway of the spring spoon spring 7 control cavity 11 with the apex cylinder 13 engaged on the spring leg.

Figure 15:
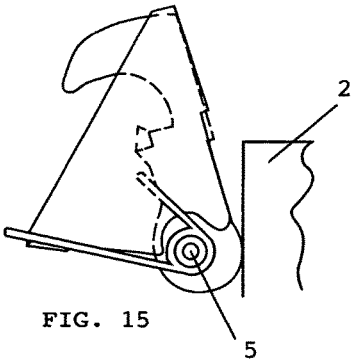
FIG. 15. Shows the spring legs having been secured in the spring hooks of the hamAR cage and the group is free to rotate some degrees of rotation on the hammer pin and all hammer spring force is eliminated from acting on the hammer pin.

FIG. 15. Shows the spring legs having been secured in the spring hooks 10 of the hamAR cage 6 and the group is free to rotate some degrees of rotation on the hammer pin 5 and all hammer spring force is eliminated from acting on the hammer pin.

Figure 16:
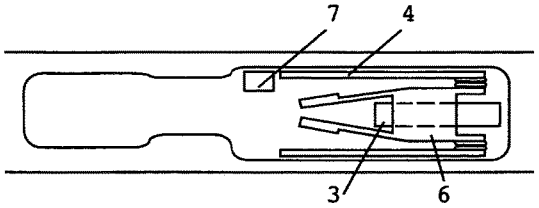
FIG. 16. Shows a top view of the hamAR cage engaged on the hammer assembly and rotated as shown in FIG. 13 and the spring spoon positioned to be engaged on the hammer spring leg.

FIG. 16. Shows a top view of the hamAR cage 6 engaged on the hammer and spring assembly 3,4 and rotated on hammer pin 5 as shown in FIG. 13 and the spring spoon 7 positioned to be engaged on the hammer spring leg.

I claim:

1. A firearm hammer spring removal and installation kit comprising:

a spring spoon, a spring retainer, said spring retainer comprising:

a channel having a left and right substantially acute triangular blades substantially parallel to each other;

the unitary region between said blades being a substantially rectangular backbone;

said blades oriented similarly on said backbone;

said blades defining an inner area between them;

the region of the spring retainer where said blades join said backbone being substantially similar to side A of a right triangle;

The region of the spring retainer proximal to side B of the triangle being the lower portion of the spring retainer;

the region opposite the lower portion being the upper portion;

the region of said blades opposite said backbone defining a spring hook;

said spring hooks being distal from said backbone and being substantially rectilinear tabs extending downward from side B;

said spring hooks forming an open top channel extending outward from said blades;

said lower region of said blades proximal to said backbone defining a semicircular spring saddle;

said blades region between said backbone and said spring hooks defining a first and second plane, said first plane proximal to said backbone of said left blade being substantially parallel to the similar plane of said right blade, said second planes being distal to said backbone being converging toward said inner area, said spring hooks being substantially within said first plane;

said spring spoon comprising:

a shaft having a length, thickness, width and opposite ends;

a first end defining a conical spring control cavity whose axis is substantially ninety degrees to the said length and its opening diameter is substantially equal to said thickness, and further defining a cylinder apex, both center lines being axial whose entry is the apex of said conical cavity, together their total depth being less than said width, and first said end further defining a radius radiating from the center of said control cavity substantially equal to one half said thickness defining a keen edge proximal to said conical spring control cavity.

2. A method to remove and install a firearm hammer and spring consisting of the kit described in claim 1 and a firearm:

said firearm's receiver defining a firing mechanism cavity having opposing walls, said walls at least defining two opposing hammer pivot pin apertures;

said firearm at least including a firing hammer, hammer spring and hammer pivot pin;

said hammer having a hammer face end, a length, a thickness and two sides;

said hammer defining a hammer pivot pin aperture on an opposite end;

said pivot pin apertures adaptive to slideably receive said pivot pin;

said hammer having spring mount bosses on each side coaxial to said hammer pivot pin aperture on said opposite end;

said hammer spring being double torsion spring with its region between the coils looped around the back of said hammer opposite its face, its coils mounted over said spring mount bosses on each side of said hammer;

said spring having legs which extend from said coils;

said spring legs having tips opposite said coils;

said firing mechanism cavity also having a feature which said legs exert torsion pressure against;

said hammer mounted in said firing mechanism cavity between said walls and said pivot pin passed through said pivot pin apertures of said walls and said hammer;

said method of use comprising:

confirm all ammunition is cleared from said firearm and especially its ammunition chamber;

removing any features blocking access to said firing mechanism cavity;

positioning said spring retainer on said hammer and spring by passing said blades on each side of said hammer until said backbone rests on said hammer face and said spring saddle rests on said spring coils;

pivotably urging said spring hooks toward said spring leg tips;

said spring spoon is manipulated into said firing mechanism cavity with said spring control cavity facing said hammer spring leg tip, the spoon being advanced on said hammer spring leg as said keen edge is used to urge the spring tip into said apex cylinder;

while continuing to exert force on the spoon toward said hammer spring coil the spring leg is lifted and engaged into said spring hook;

the process is repeated on the second spring leg;

said pivot pin is pushed out of said apertures sans hammer spring pressure;

said hammer with spring can be removed from said firing mechanism cavity;

said spring legs removed from said hooks;

said spring retainer may be disengaged from said hammer and spring; and the method is reversed for installation of said hammer and hammer spring except confirming clearing all ammunition should be performed first.

* * * * *